United States Patent [19]

Towner

[11] 4,406,601

[45] Sep. 27, 1983

[54] ROTARY POSITIVE DISPLACEMENT MACHINE

[75] Inventor: Joseph L. Towner, Corning, N.Y.

[73] Assignee: Ingersoll-Rand Company, Woodcliff Lake, N.J.

[21] Appl. No.: 222,050

[22] Filed: Jan. 2, 1981

[51] Int. Cl.[3] ..... F01C 1/18; F04C 18/18

[52] U.S. Cl. ..... 418/191

[58] Field of Search ..... 418/78, 189, 191, 205, 418/206

[56] References Cited

U.S. PATENT DOCUMENTS

| | | | |
|---|---|---|---|
| 3,472,445 | 10/1969 | Brown | 418/189 |
| 3,894,822 | 7/1975 | Abaidullin et al. | 418/191 |
| 3,989,413 | 11/1976 | McGahan et al. | 418/206 |
| 4,138,848 | 2/1979 | Bates | 418/191 |
| 4,224,016 | 9/1980 | Brown | 418/191 |
| 4,324,538 | 4/1982 | Brown | 418/191 |

*Primary Examiner*—Craig R. Feinberg
*Assistant Examiner*—W. R. Wolfe
*Attorney, Agent, or Firm*—B. J. Murphy

[57] ABSTRACT

The invention concerns the formation of the high pressure port in a rotary, positive displacement machine, such as a gas compressor, with an extension which is traversed by the plane on which the parallel axes of the rotors are commonly positioned. A given portion of the port extension is constantly occluded by the gating rotor and, consequently does not add to the effective area of the port. However, the remaining portion of the extension is exposed by the gating rotor, effectively defining a port opening which reaches to the common plane. Thus, in gas compressor use of the machine, the port extension insures that all the compressed gas product is delivered through the exhaust port.

5 Claims, 4 Drawing Figures

ROTARY POSITIVE DISPLACEMENT MACHINE

This invention pertains to rotary, positive displacement machines for handling a working fluid, such as gas and, in particular, to such machines as are useful as gas compressors or gas expanders, or the like.

Machines of the type to which the invention pertains are rather well known in the prior art, particularly from U.S. patents granted to Arthur E. Brown, U.S. Pat. Nos. 3,535,060, 3,472,445 and 4,224,016, issued on Oct. 20, 1970, Oct. 14, 1969, and Sept. 23, 1980, for "Rotary Displacement Machines", and "Rotary Positive Displacement Machines", and Canadian Patent No. 965,354 issued to Bo O. R. Arnegard, et al., on Apr. 1, 1975, for "Rotary Piston Machines."

U.S. Pat. No. 3,472,445 issued to Brown appears to have set forth the first teaching of the optimum location and definition or configuration of the high-pressure port in the end wall (or walls) of a rotary displacement machine such as a gas compressor. The Brown teaching is of defining the port with an arcuate edge which conforms and aligns, axially, with the outermost reach or tip of the main rotor tooth. Thus, as the high-pressure port is closed over, by the interengagement of the coacting rotor teeth and grooves, substantially all of the product gas will be delivered, therethrough (in a gas compressor function, wherein the port is an exhaust port).

In U.S. Pat. No. 3,535,060, column 5, lines 73 through 75, Brown makes the point that the end wall exhaust port should have an optimum shape and area. More pointedly, in the referenced Canadian patent it is suggested, with some want of clarity, that the end wall exhaust port should extend to (a) within approximately twenty degrees of the common plane in which the rotors are journaled, and (b) to the plane whereat sealing lines between the rotors coincide. Well, extension to about twenty degrees of the common plane of rotor journaling appears to be comprised by prior art (including the Brown U.S. Pat. No. 3,472,445), and extension to the plane whereat the sealing lines coincide is *not* ". . . approximately 20 degrees about the axis of rotation . . . " of the gating rotor from the common plane. Rather, the sealing lines coincide on said common plane. If the Canadian patent disclosure is ambiguous, and if the Brown patent defined only a desired feature, it is a fact of manufacturing reality that it has not been possible to define the exhaust port with a sufficient extension. Accordingly, there has always been a minor portion of the compressed-gas product which is not deliverable and must be dumped back to the inlet.

It is an object of this invention to disclose a rotary positive displacement machine having an end wall exhaust port with an extension which, in use of the machine as a gas compressor, will insure the delivery of all the product gas (except for gas lost internally in the machine).

It is another object of this invention to set forth a rotary positive displacement machine adapted to handle a working fluid, comprising: a casing structure having two intersecting bores and end walls; a first rotor mounted for rotation in one said bore; and a second rotor mounted for rotation in the other said bore; wherein each rotor has a hub and at least one lobe; each lobe is integral with a respective hub and projects generally radially outward therefrom, defining an outermost radial surface of the rotor; each hub has formed therein at least one groove; defining an innermost radial surface of the rotor, to receive, interengagingly therein, one of said lobes; said hubs are configured so as to rotate in substantially sealing relation to each other during at least a portion of each rotation; said casing structure has a first port for the passage therethrough of the working fluid at a given pressure, and a second port for the passage therethrough of the working fluid at higher pressure than said given pressure; at least a portion of said second port is located in an end wall of the bore containing said first rotor, and has a radially innermost edge, a radially outermost edge, and an arcuate edge joining said innermost and outermost edges; said hub of the first rotor and its groove therein comprise means for cyclically covering and uncovering said second port so as to control the flow of the higher-pressure working fluid through said second port; said rotors are adapted to displace the working fluid inside said bores; said machine has a built-in compression ratio, when operating as a fluid compressor, such that the working fluid is compressed internally within the machine before passing through said second port, and a built-in expansion ratio, when operating as a fluid expander, such that the working fluid expands internally within the machine before passing through said first port; said outermost radial surface of said second rotor, during rotation of the latter, and said arcuate edge of said port, describe a first, substantially common, radial arc; and said radially innermost edge of said second port has a major portion thereof which, with rotor rotation, comes into substantially axial alignment with said groove in said first rotor, and has a minor portion thereof which is constantly occluded by said first rotor.

It is also an object of this invention to set forth a rotary positive displacement machine adapted to handle a working fluid, comprising: a casing structure having two intersecting bores and end walls; a first rotor mounted for rotation in one said bore; and a second rotor mounted for rotation in the other said bore; wherein each rotor has a hub and at least one lobe; and each lobe is integral with a respective hub and projects generally radially outward therefrom, defining a outermost radial surface of the rotor; each hub has formed therein at least one groove, defining an innermost radial surface of the rotor, to receive, interengagingly therein, one of said lobes; said hubs are configured so as to rotate in substantially sealing relation to each other during at least a portion of each rotation; said casing structure has a first port for the entry therethrough of the working fluid at a given pressure, and a second port for the discharge therethrough of the working fluid at higher pressure than said given pressure; at least a portion of said second port is located in an end wall of the bore containing said first rotor, and has a radially innermost edge, a radially outermost edge, and an arcuate edge joining said innermost and outermost edges; said hub of the first rotor and its groove therein comprises means for cyclically covering and uncovering said second port so as to control the discharge of the higher-pressure working fluid through said second port; said portion of said second port has a prescribed positioning relative to said rotors, and said edges and said rotors have prescribed geometries which cooperate with said prescribed positioning of said second port portion to cause all of the working fluid which is admitted via said first port, less integral leakage fluid, to be discharged via said second port.

Further objects of this invention, as well as the novel features thereof, will become more apparent by reference to the following description, taken in conjunction with the accompanying figures in which.

Figure 1:
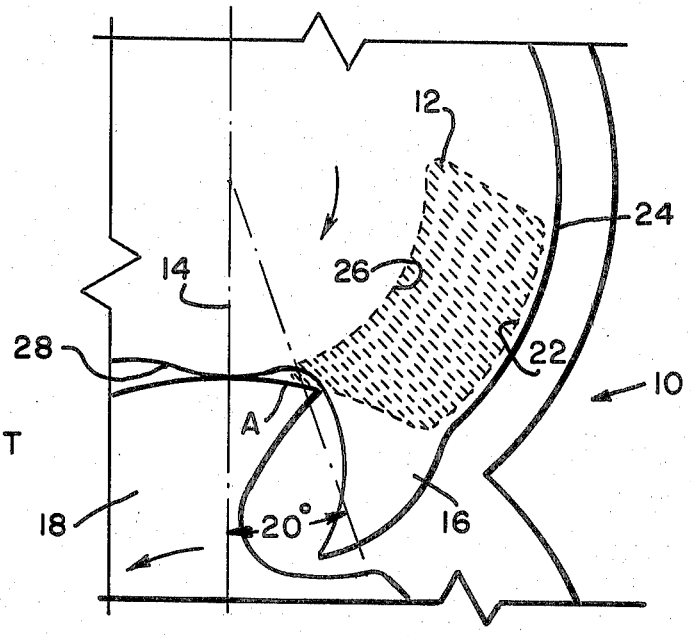
FIG. 1 PRIOR ART
FIG. 1 is a detailed illustration of a typical, end wall exhaust port, shown cross-hatched for contrast only, in a rotary positive displacement machine according to the prior art.
Figure 2:
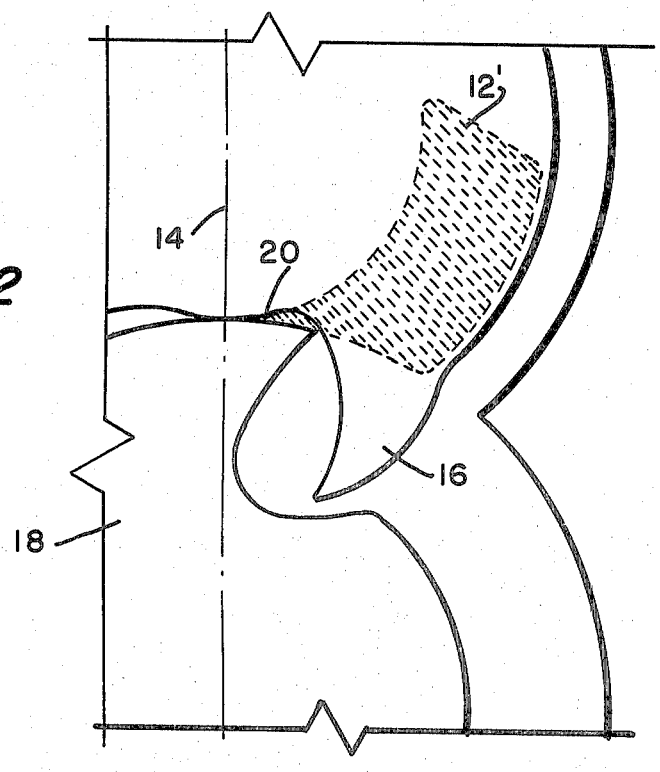
FIG. 2 is a depiction of an idealized or theoretical, end wall exhaust port, also shown cross-hatched for contrast, for such machines as aforesaid.

As shown in the figures, prior art rotary, positive displacement machines 10 have an end wall exhaust port 12 which terminates at approximately twenty degrees of arc from the plane 14 in which both the gating rotor 16 and the main rotor 18 are journaled. Simply, the twenty-degree termination is necessary due to the fact that the milling machine cannot define a smaller-radiused, narrower cut. Hence, a pocket "A" of product, compressed gas can not be delivered and must be dumped back to the inlet side of the machine. Ideally, an exhaust port 12' would extend to, and terminate at, the plane 14 in which the rotors are journaled, as shown in FIG. 2, but there is no practical way to cut such a thin, tapering and disappearing extension 20 with customary milling machines or the like. Too, to define such a cut with other machinery or hand tools is prohibitively time-consuming and expensive.

As set forth in the prior art, and notably the patents cited, the end wall exhaust port 12 has a radially outermost edge 22 which obtains at a slightly shorter radial distance than does the arc defined by the hub 24 of the gating rotor 16. This is to insure that during the compression cycle the exhaust port 12 will be occluded by the gating rotor hub 24. During the delivery cycle, the exhaust port 12 must be fully exposed and, as a consequence, the innermost edge 26 of the port is drawn on an arc which axially aligns with the arc of the groove 28 of the gating rotor 16. The innermost edge 26 of the exhaust port 12 should not extend, radially, further than the groove 28 of the gating rotor, as this would occlude some of the port and cause undue throttling thereat. Conversely, to have the edge 26 foreshortened, to underly the groove 26, would be counter-productive as the underlying portion would serve no function; such underlying portion would not contribute to the effective area of the port, and it would simply be inoperatively occluded by the rotor 16. Such is the plausible thinking in this art and, accordingly, sensibly, machines of this type have the innermost edge 26 of the high-pressure port 26 fully axially aligned with the edge of the groove 28 (which is to fully expose the port).

It is my teaching, however, to proceed counter to this prior art thinking, and deliberately define a portion of the exhaust port to underly the gating rotor so that it is constantly occluded by the gating rotor. Further, it is my teaching to define the exhaust or high-pressure port with an extension which is traversed by the plane in which the rotors are journaled. My purpose in this is to insure that, during the delivery cycle, the port is opened fully to that plane, that plane being the same in which the sealing lines coincide. Following the delivery cycle, the gating rotor 16 closes off the entire port extension of my conception, so that the extension is not, then, exposed to the inlet side of the machine.

Figure 3:
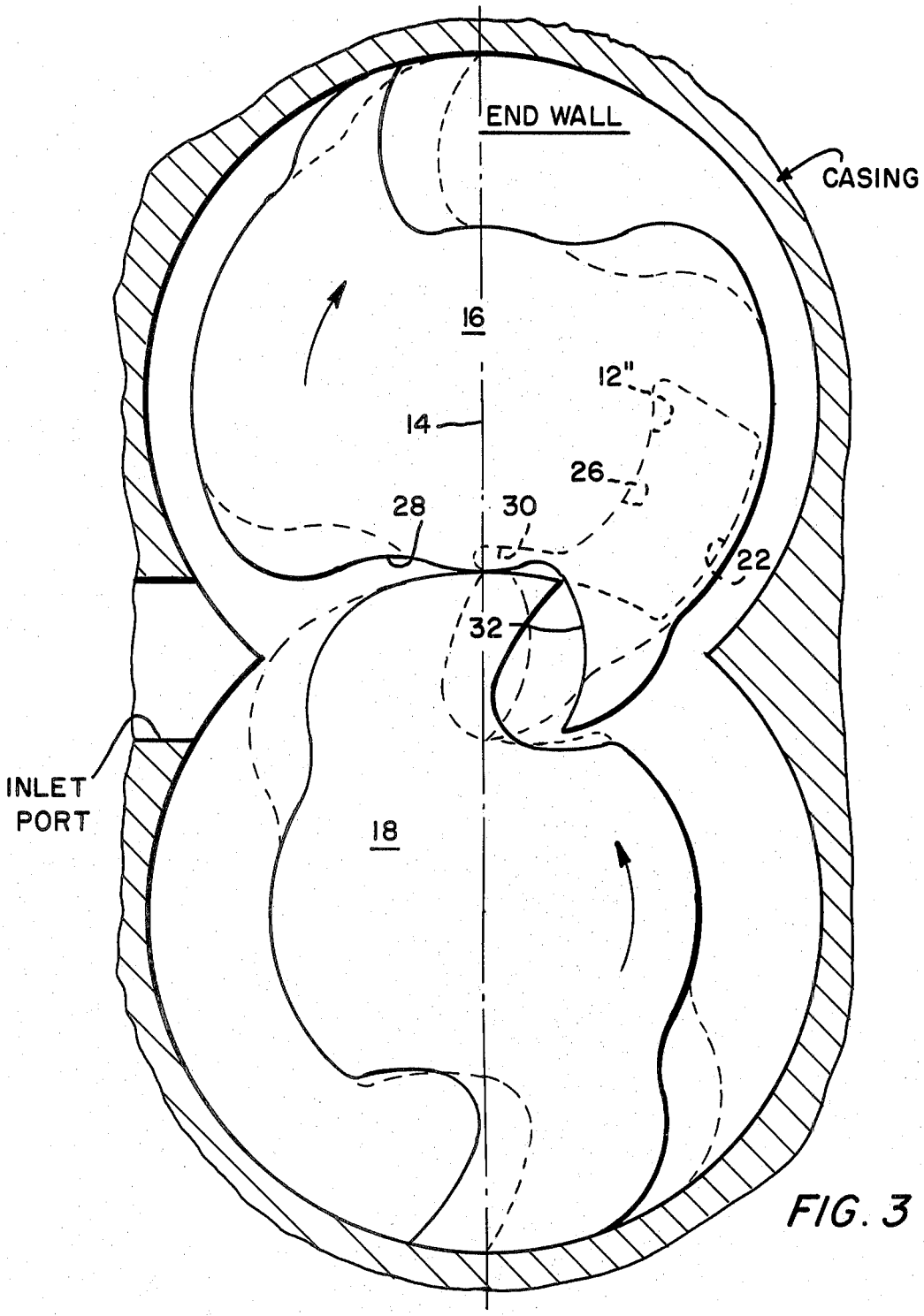
FIG. 3 is an illustration of the invention machine, according to an embodiment thereof, showing the novel exhaust port extension formed therein.
Figure 4:
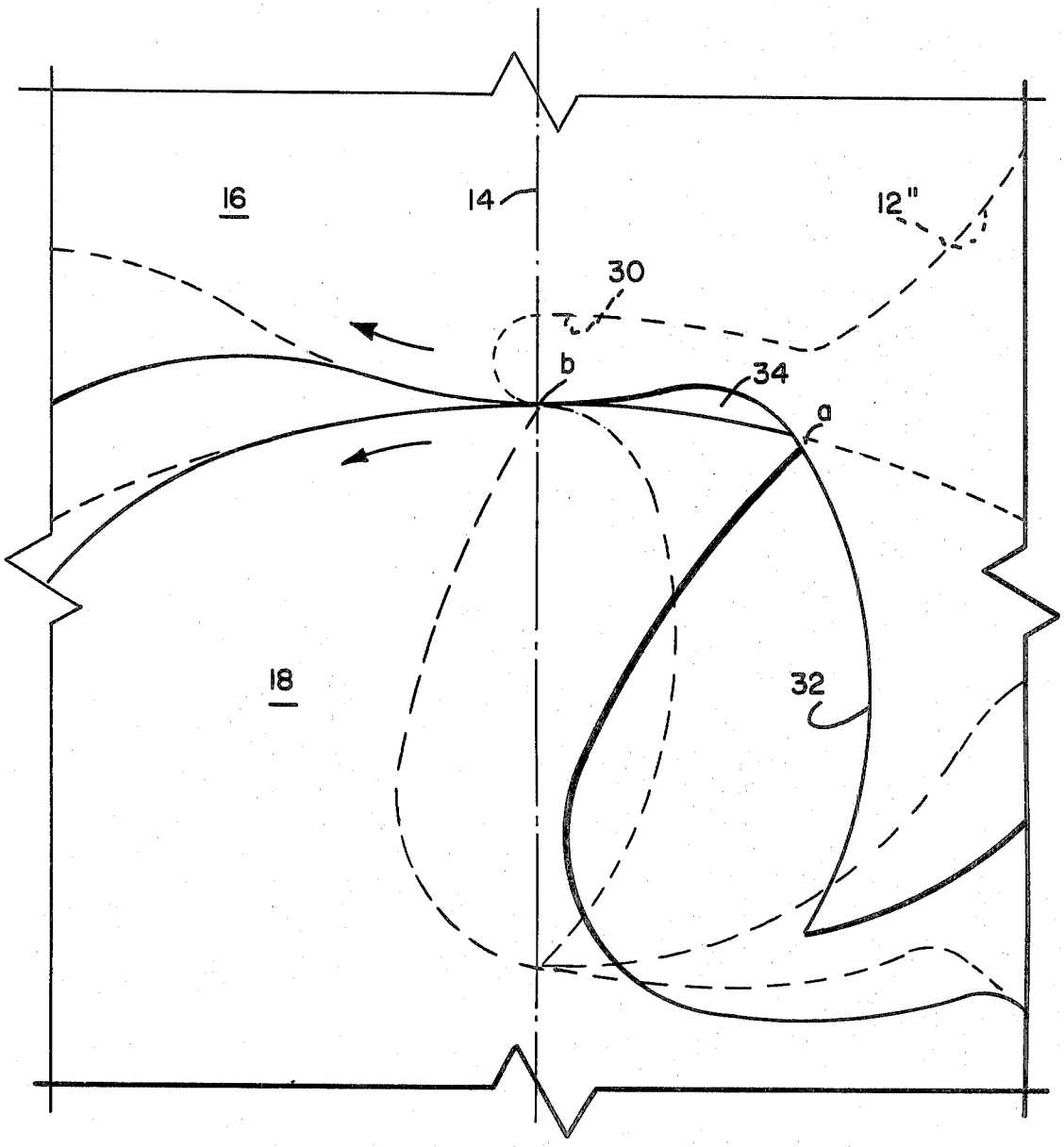
FIG. 4 is an enlarged, detailed view of the configuration of the port extension of FIG. 3 and its cooperation with the rotor geometries.

FIGS. 3 and 4 show, in full line illustration, the disposition of the rotors 16 and 18 prior to the final or terminal delivery of the product gas. My invention comprises the formation of an extension 30, for the end wall exhaust port 12'', having a width which can be cut by a conventional milling machine.

It will be seen that, while a substantial portion of the exhaust port extension 30 is occluded by the gating rotor 16, a minor portion thereof can remain open fully to the plane 14 whereat the rotors 16 and 18 are journaled.

The rotors 16 and 18 define sealing lines "a" and "b", the latter always occuring on the plane 14. Now, when the sealing lines coincide, the rotors are in the dashed-line positionings shown (FIGS. 3 and 4). At such time, the concave flank 32 of the gating rotor 16 is just concluding a closure of the smallest portion of the extension 30. Immediately thereafter, the extension 30 is fully occluded. However, while the rotors travel from the full-line positioning to the dashed-line positioning, the extension 30 provides an access 34 for the last portion of product gas to be delivered into the end wall exhaust port 12''.

By milling a greater exhaust port extension 30 than can be useful, I teach how to thereby define, of such extension 30, a minor portion thereof which is not only functional, but comprises the means for insuring delivery of all possible product gas.

While I have described my invention in connection with a specific embodiment thereof, it is to be clearly understood that this is done only by way of example, and not as a limitation to the scope of my invention as set forth in the objects thereof and in the appended claims.

I claim:

1. A rotary, positive displacement machine adapted to handle a working fluid, comprising:

a casing structure having two intersecting bores and end walls;

a first rotor mounted for rotation in one said bore; and a second rotor mounted for rotation in the other said bore; wherein each rotor has a hub and at least one lobe;

each lobe is integral with a respective hub and projects generally radially outward therefrom, defining an outermost radial surface of the rotor;

each hub has formed therein at least one groove; defining an innermost radial surface of the rotor, to receive, interengagingly therein, one of said lobes;

said hubs are configured so as to rotate in substantially sealing relation to each other during at least a portion of each rotation;

said casing structure has a first port for the passage therethrough of the working fluid at a given pressure, and a second port for the passage therethrough of the working fluid at higher pressure than said given pressure;

at least a portion of said second port is located in an end wall of the bore containing said first rotor, and has a radially innermost edge, a radially outermost edge, and an arcuate edge joining said innermost and outermost edges;

said hub of the first rotor and its groove therein comprise means for cyclically covering and uncovering said second port so as to control the flow of the higher-pressure working fluid through said second port;

said rotors are adapted to displace the working fluid inside said bores;

said machine has a built-in compression ratio, when operating as a fluid compressor, such that the working fluid is compressed internally within the machine before passing through said second port, and a built-in expansion ratio, when operating as a fluid expander, such that the working fluid expands internally within the machine before passing through said first port;

said outermost radial surface of said second rotor, during rotation of the latter, and said arcuate edge of said port, describe a first, substantially common, radial arc;

said radially innermost edge of said second port has a major portion thereof which, with rotor rotation, comes into substantially axial alignment with said groove in said first rotor, and has a minor portion thereof which is constantly occluded by said first rotor;

said first and second rotors are mounted for rotation on parallel axes on a common plane; and said end wall portion of said second port is traversed by said common plane.

2. A rotary, positive displacement machine, according to claim 1, wherein:

said minor portion of said innermost edge of said second port lies beyond the rotary sweep of said second rotor.

3. A rotary, positive displacement machine, according to claim 1, wherein:

said first and second rotors are mounted for rotation on parallel axes on a common plane;

said rotors define therebetween first and second sealing lines, which, during rotor rotation, obtain a given distance apart at a given time during a given cycle of rotation of said rotors, and come into coincidence, on said common plane, at a following time during said given cycle of rotor rotation; and said rotors and said second port have geometries cooperative for (a) preventing full occlusion of said port between said given and following times, and (b) causing full occlusion of said port immediately subsequent to said following time.

4. A rotary, positive displacement machine, according to claim 1, wherein:

said major portion of said radially innermost edge of said second port describes a second arc, drawn from the radial center of said first rotor, which second arc is substantially the same as an arc, described, during rotation thereof, by said innermost radial surface of said first rotor; and said minor portion of said innermost edge of said second port is radially inward relative to said second arc.

5. A rotary, positive displacement machine, according to claim 4, wherein:

said minor portion of said innermost edge of said second port and said arcuate edge of said second port are substantially parallel.

* * * * *